US005515564A

United States Patent [19]

Lyons

[11] Patent Number: 5,515,564

[45] Date of Patent: May 14, 1996

[54] SUN SHIELD

[76] Inventor: Thomas R. Lyons, 5253 SW. Fairlane Ave., Stuart, Fla. 34997

[21] Appl. No.: 285,020

[22] Filed: Aug. 2, 1994

[51] Int. Cl.[6] ..... A47C 20/00

[52] U.S. Cl. ..... 5/639; 5/643; 5/418; 383/4; 190/1

[58] Field of Search ..... 5/643, 639, 418, 5/419, 417; 190/1, 2, 127, 122, 110, 107; 383/4

[56] References Cited

U.S. PATENT DOCUMENTS

| | | | |
|---|---|---|---|
| 982,442 | 1/1911 | Rebhun | 5/643 |
| 2,817,857 | 12/1957 | Hockensmith | 5/639 |
| 2,932,833 | 4/1960 | Wambach | 5/418 |
| 3,263,246 | 8/1966 | Towery | 5/643 |
| 4,082,102 | 4/1978 | Heuer . | |
| 4,100,633 | 7/1978 | Pintos . | |
| 4,277,859 | 7/1981 | Seaman | 5/639 |
| 4,298,103 | 11/1981 | De Fries | 5/643 |
| 4,425,675 | 1/1984 | Victor . | |
| 4,639,958 | 2/1987 | Lerner . | |
| 5,072,429 | 12/1991 | Mair | 5/639 |
| 5,320,405 | 7/1994 | Foster | 5/418 |

FOREIGN PATENT DOCUMENTS

| | | | |
|---|---|---|---|
| 276981 | 11/1951 | Switzerland | 5/643 |

*Primary Examiner*—Flemming Saether
*Attorney, Agent, or Firm*—Dickstein, Shapiro & Morin

[57] ABSTRACT

The present invention is a sun shield which can be easily attached and/or detached from most standard sized beach chairs. In another embodiment, the sun shield is attached to a frame which has a bag stretched around the frame to provide a carrying case for beach items as well as a comfortable pillow for the user to rest his/her head upon. Additionally, the sun shield may fold up to act as a handle, and to facilitate carrying that bag. In yet another embodiment of the invention, the sun shield is attached to a cooler which is designed to carry items in a cooling environment to or from the beach and/or the poolside. It also provides the user with a comfortable headrest to rest his or her head upon while sunbathing.

6 Claims, 4 Drawing Sheets

SUN SHIELD

BACKGROUND OF THE INVENTION

The present invention relates to a sun shield in general, and more particularly to a sun shield which can be easily attached to a beach chair or other device for supporting the user's head and/or carrying items to the beach such as a bag-pillow combination and a cooler-pillow combination.

As beachgoers have become more aware of the necessity to protect their skin, specifically their faces, from the sun to avoid ultraviolet damage to their skin, sun shields have become a necessary object on the beach and/or by the pool.

Typically, a user must carry a sun shield to the beach which can be large and cumbersome. Additionally, that sun shield may not be able to attach to the user's beach chair which may cause it to rest uneasily or unevenly over the user and accordingly, the user may become sunburned from its improper placement.

Another problem with known designs of sun shields is that the user must carry not only a sun shield, but additionally a beach bag and pillow. This may prove to be cumbersome.

A further problem of the known art is that the user must, in addition to any of the above items, carry a cooler to bring drinks or food to the beach or poolside for use while sunbathing and relaxing.

SUMMARY

The present invention alleviates to a great extent the disadvantages of the prior art by providing a sun shield which can be easily attached and/or detached from most standard sized beach chairs. Likewise, the sun shield may be easily folded to facilitate easy carrying to and from the beach or poolside.

In another aspect, the sun shield is attached to a frame which has a bag stretched around the frame to provide a carrying case for beach items as well as a comfortable pillow for the user to rest his/her head upon. Additionally, the sun shield may fold up to act as a handle and to facilitate carrying that bag.

In another aspect of the invention, the sun shield is attached to a cooler which is designed to carry items in a cooling environment to or from the beach and/or the poolside. It also provides the user with a comfortable headrest to rest his or her head upon while sunbathing.

It is an object of the present invention to provide a sun shield which can be easily carried as well as attached and detached from a beach chair.

It is another object of the present invention to provide a sun shield which is attached to a bag but may also be used as a headrest.

It is yet another object of the present invention to provide a sun shield which may easily be attached to a cooler to carry items at a desired temperature that can also be used as a headrest.

It is still another object of the present invention to provide a sun shield with the above advantages that may be easily folded, thereby, facilitating carrying the sunshield with attached cooler and/or bag.

With these and other objects, advantages and features of the invention that may become apparent, the nature of the invention may be more clearly understood by reference to the following detailed description of the invention, the appended claims and the several drawings attached hereto.

DESCRIPTION OF PREFERRED EMBODIMENTS

Figure 1:
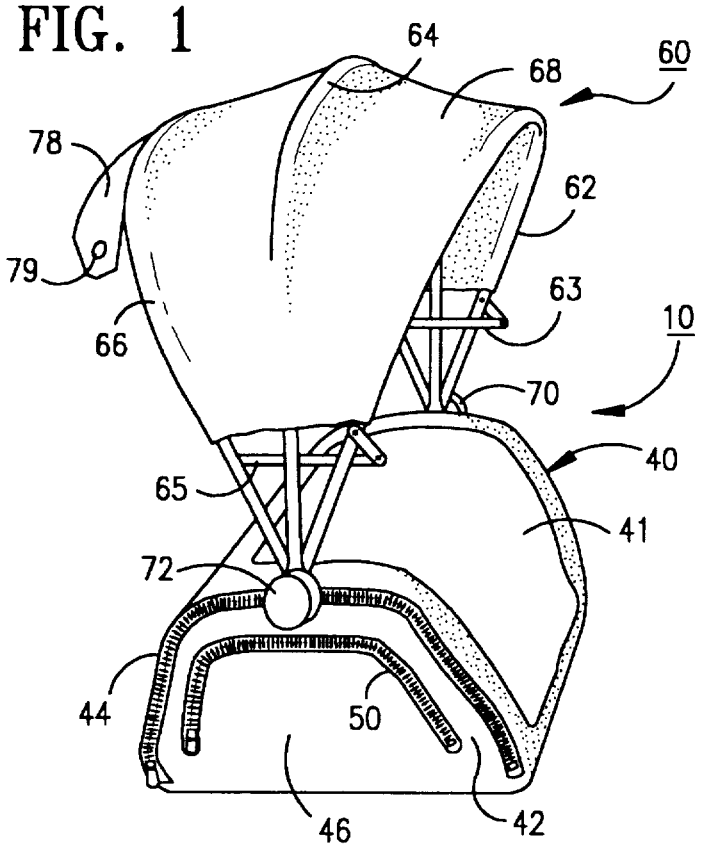
FIG. 1 is a perspective view of a headrest and bag of a first embodiment of the present invention with a sun shield attached.

Refer now to the drawings, particularly FIGS. 1–6 which show a headrest, generally designated by reference numeral 10, according to a first preferred embodiment of the present invention. Headrest 10 includes a frame 20 with a bag 40 fitted around it which can be used to carry items. This embodiment of headrest 10 also includes a sun shield 60 attached to the bag to shield the user from the sun. Optionally, the bag 40 can also include a removable interior bag 56, a removable exterior bag 11, a removable interior cooler 15, and a detachable cushion 41. Each of these elements will be more fully described below.

Figure 2:
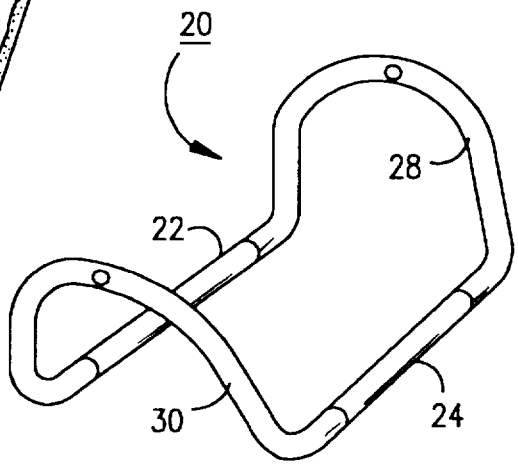
FIG. 2 is a perspective view of the frame of the embodiment of FIG. 1.

As shown in FIG. 2, a frame 20 includes a rear base frame piece 22 which is generally parallel to a front base frame piece 24. Curved or angled right and left upright frame pieces 28, 30 are attached perpendicularly to the front and rear base frame pieces 22, 24.

Figure 3:
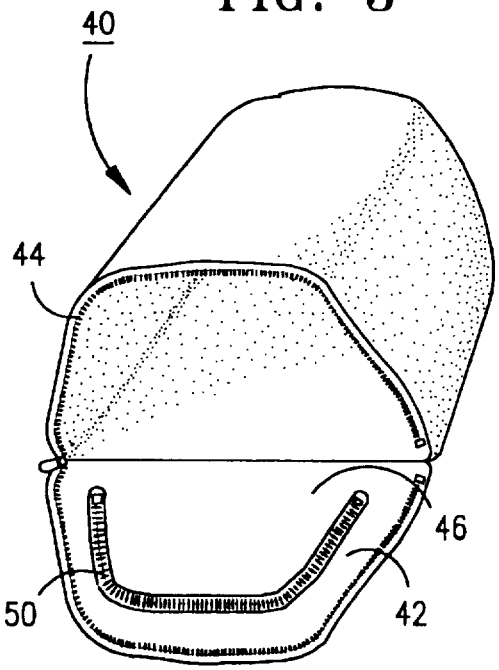
FIG. 3 is a perspective view of the bag of the embodiment of FIG. 1.

As shown in FIG. 3, the bag 40 is shaped and sized for fitting over and around the frame 20. The bag 40 has a side bag flap 42 which opens and closes a side end of the bag 40 by the use of the zipper 44. On the side flap of the bag 42 is attached a side pocket 46 with a side pocket flap on the outside and a side pocket zipper 50 to close the side pocket.

Figure 4:
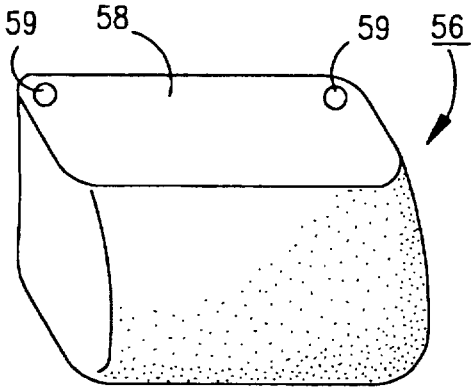
FIG. 4 is a perspective view of the interior bag of the embodiment of FIG. 1.

As shown in FIG. 4, the headrest 10 also includes an interior bag 56 sized and shaped to fit into the bag 40. This bag allows one user to carry around objects in a secure bag while the other continues to use the headrest 10. The interior bag 56 has a top interior bag flap 58 and interior bag snaps 59, 59 to open and close the interior bag flap 58 to the interior bag 56.

The headrest 10 also includes a detachable cushion 41 which is attached to the top of the bag 40 so that the head rest is more comfortable in use.

As shown in FIG. 1, headrest 10 further includes a sun shield 60 attached to the frame 20 to prevent the user from getting too much sun exposure to his or her face. The sun shield 60 is made up of forward, center and rear ribs 62, 64, 66 respectively, each of which is curved and converges with the others at respective ends thereof. The ribs 62, 64, 66 are rotatably mounted to a right and left adjusting knob 70, 72 at opposite ends thereof so that the ribs 62, 64, 66 may be moved closer and farther away from each other to facilitate opening and closing of the sun shield 60. The sun shield 60 has right and left hinges 63, 65 attached respectively to the right and left ends of the forward and rear ribs 62, 66 to maintain the shade in an open or closed condition. A sun shield cover 68 preferably made of a effective sunshine attenuating flexible covering material to block the sun is attached to the ribs 62, 64, 66 in a manner so that when the ribs 62, 64, 66 are spread open, the sun shield cover 68 is stretched open and when the ribs 62, 64, 66 are pushed close together, the sun shield cover 68 collapses over and between them. The right and left adjusting knobs 70, 72 are respectively rotatably mounted through the bag 40 to the right and left upright frame pieces 28, 30 by respective right and left mounting means 74, 76 such as threaded screws with bolts attached to the ends of the screws.

As shown in FIG. 1, the sun shield 60 has a sun shield closure device 78 attached to the top of the sun shield cover 68 to be wrapped around the closed ribs 62, 64, 66 of the sun shield 60 to facilitate carrying the head rest, bag and sun shield. The sun shield closure device 78 may be fastened shut with a snap 79.

Figure 5:
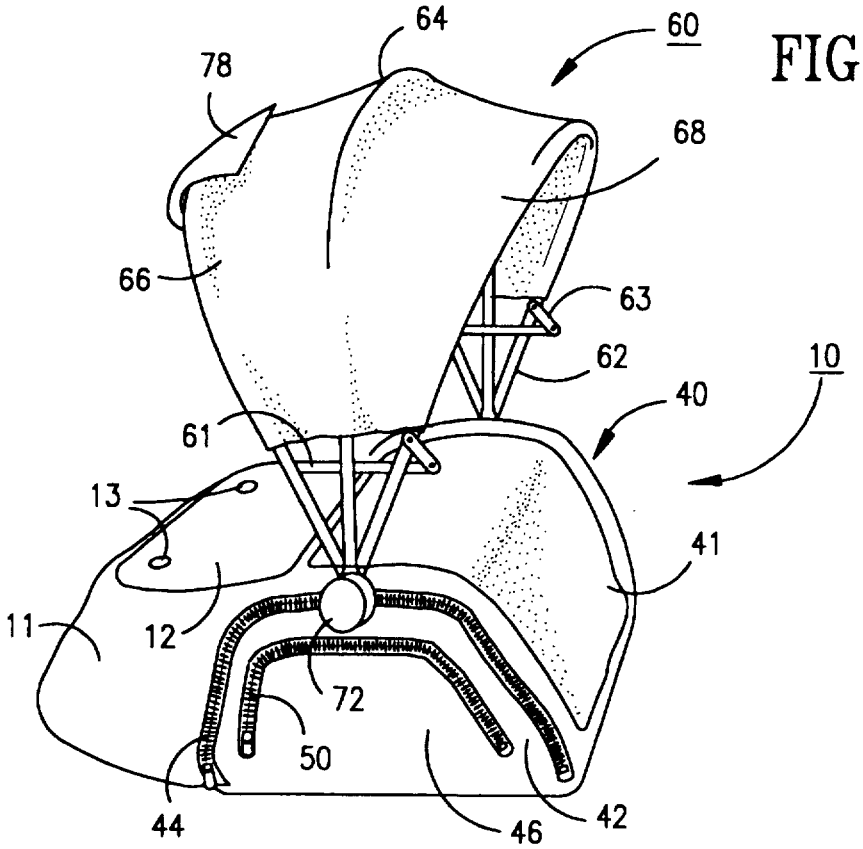
FIG. 5 is a perspective view of the bag and sunshield of embodiment of FIG. 1 with an exterior bag attached.

As shown in FIG. 5, headrest 10 further includes an exterior bag 11. This bag allows one user to carry around objects in a secure bag while the other continues to use the headrest 10. The exterior bag has a top exterior bag flap 12 and exterior bag snaps 13,13 to open and close the exterior bag flap 12 to the exterior bag 11. The exterior bag is attached to the headrest by velcro or snaps (not shown).

Figure 6:
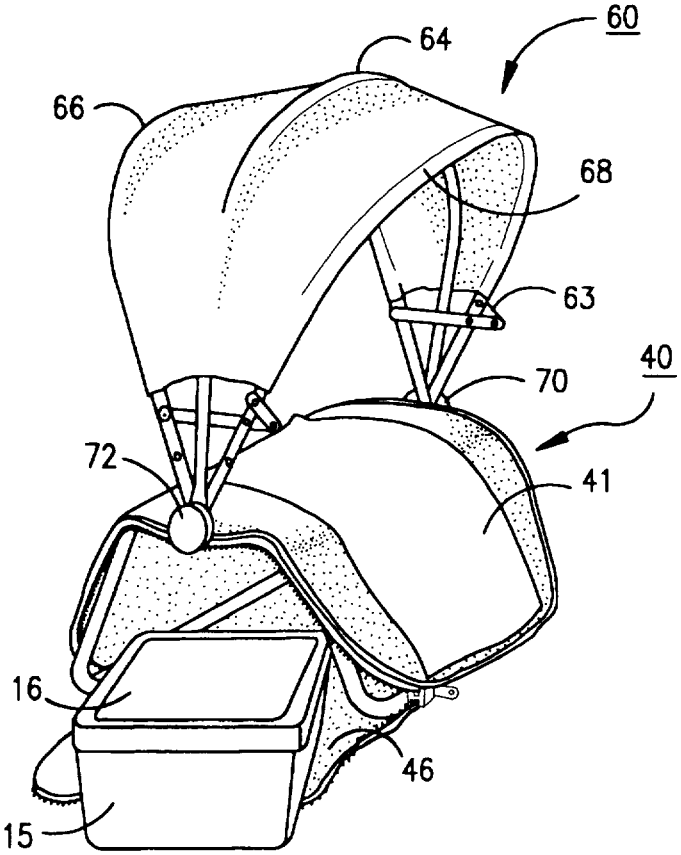
FIG. 6 is a perspective view and sunshield of embodiment of FIG. 1 with a cooler inside.

As shown in FIG. 6, the headrest 10 further includes an interior cooler 15 to store items in a temperature controlled environment. The interior cooler 15 has an interior cooler top 16 to open and close the interior cooler 15.

Figure 7:
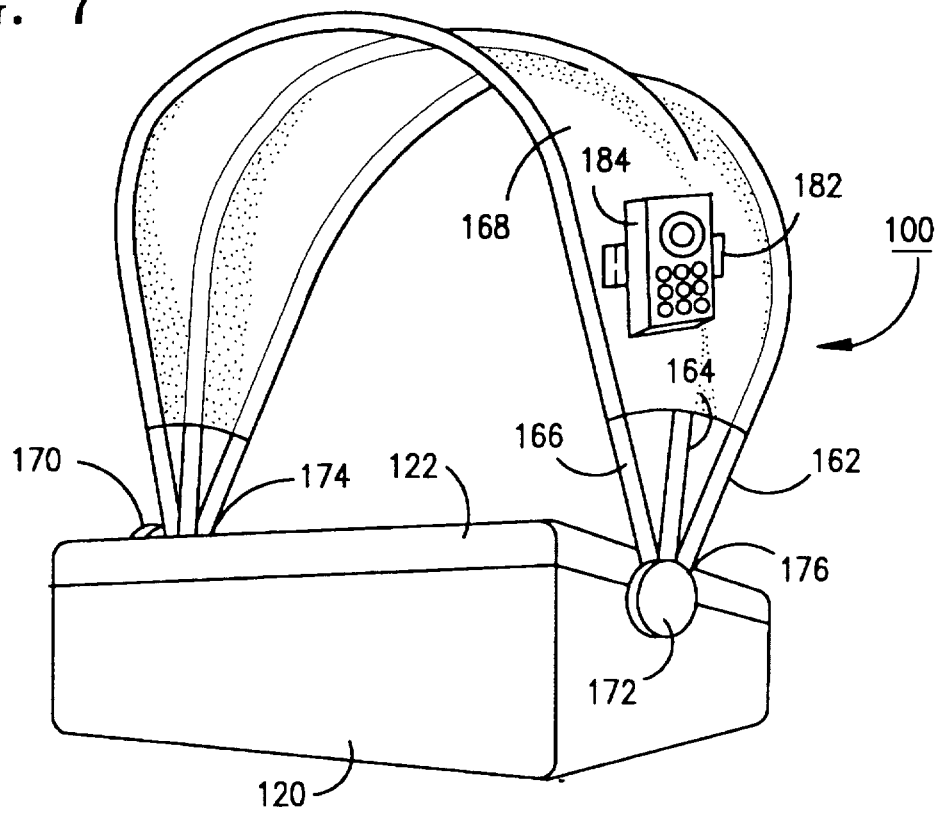
FIG. 7 is a perspective view of a cooler with sun shield attached of a second embodiment.
Figure 8:
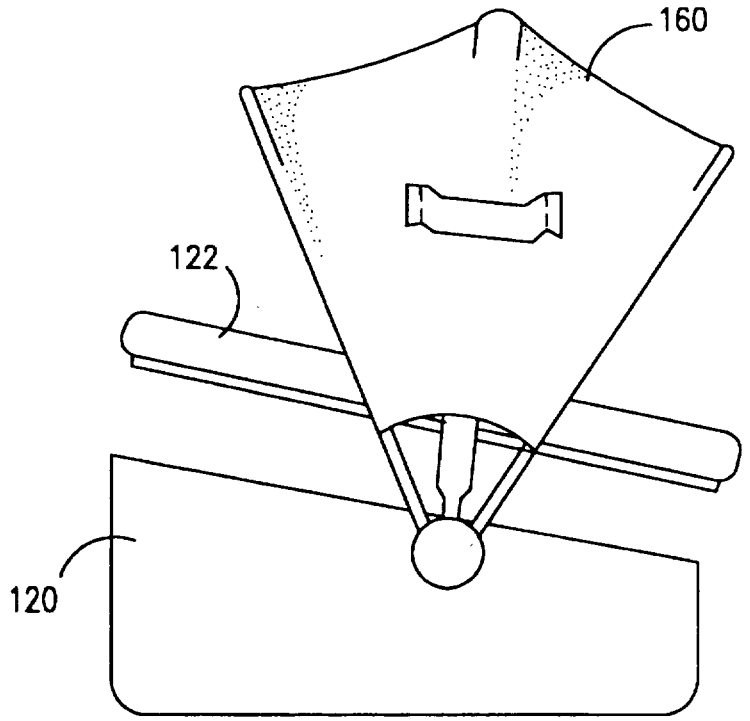
FIG. 8 shows a side view of the embodiment of FIG. 7.
Figure 9:
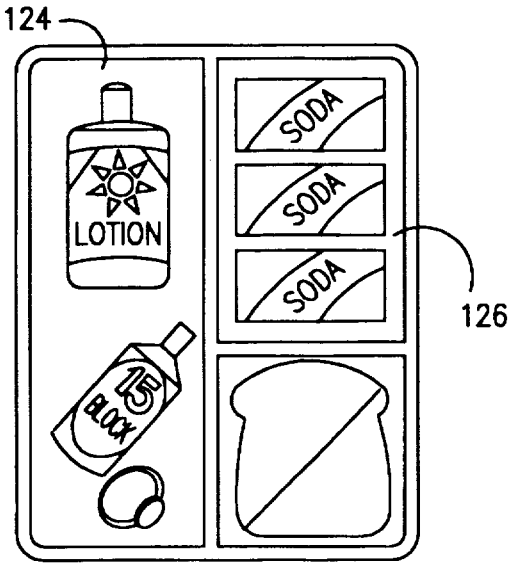
FIG. 9 is an overhead view of the embodiment of FIG. 7 without the sun shield.

A headrest 100 constructed according to a second embodiment of the present invention is illustrated in FIGS. 7–9. Headrest 100 includes a cooler 110 for carrying items in a climate-controlled environment with a sun shield attached for blocking the user from the sun.

The cooler 110 includes a rectangular cooler base 120 whose top side is angled downward from back to front with an insulating material inside 126. A cooler lid 122 is made of a material that provides a cushioning top surface and is removably placed onto the cooler base 120 to form a substantially airtight seal in the cooler 110 to help maintain the temperature inside the cooler 110. The cooler 110 has compartments 124 inside to keep items from sliding into other items.

As shown in FIGS. 7 and 8, the headrest 100 also includes a sun shield 160 attached to the cooler 110 to prevent the user from getting too much sun exposure to his or her face. The sun shield 160 includes a forward, center and rear rib 162, 164, 166 which are each curved and converge with the others at their respective ends thereof. The ribs 162, 164, 166 are rotatably mounted to a right and left adjusting knob 170, 172 at opposite ends thereof so that the ribs 162, 164, 166 may be moved closer and farther away from each other to facilitate opening and closing of the sun shield 160. The sun shield has right and left hinges 163, 165 attached respectively to the right and left ends of the forward and rear ribs 162, 166 to maintain the shade in an open or closed condition.

A sun shield cover 168 preferably made of a effective sunshine-attenuating flexible covering material to block the sun is attached to the ribs 162, 164, 166 in a manner so that when the ribs 162, 164, 166 are spread open, the sun shield cover 168 is stretched open and when the ribs 162, 164, 166 are pushed close together, the sun shield cover 168 collapses over or between them. The right and left adjusting knobs 170, 172 are respectively rotatably mounted to the right and left sides of the cooler 110 by respective right and left mounting means 174, 176 such as threaded screws with bolts attached to the ends of the screws.

Figure 11:
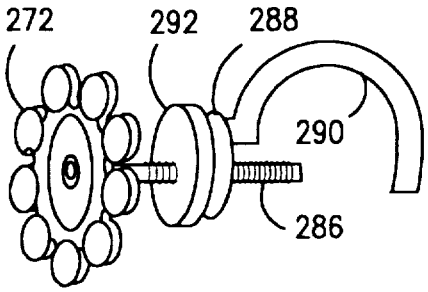
FIG. 11 shows a perspective view of the mounting mechanism of the embodiment of FIG. 10.
Figure 10:
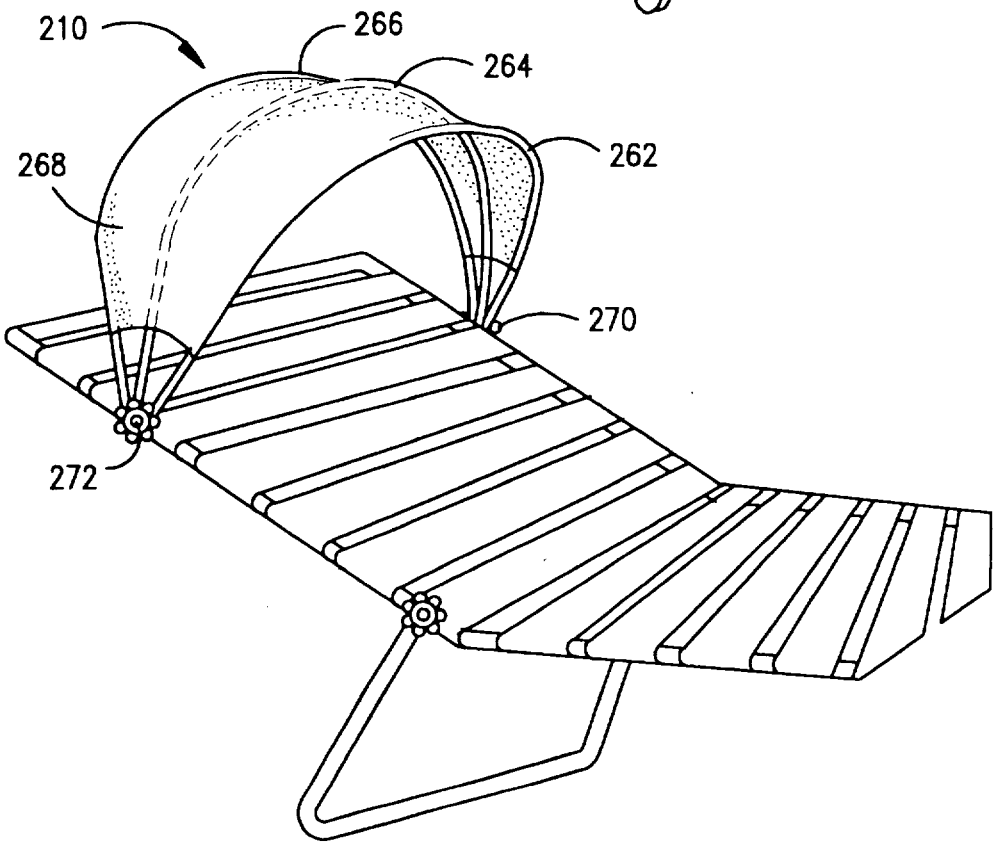
FIG. 10 is a perspective view of a sun shield attached to a beach chair of a third embodiment.

A third embodiment of the present invention shown in FIGS. 10 and 11 provides a detachable sun shield device 210 for a beach chair or the like. The sun shield device 210 is made up of forward, center and rear ribs 262, 264, 266 which are each curved and converge with the others at respective ends thereof. The ribs 262, 264, 266 are rotatably mounted to a right and left adjusting knob 270, 272 at opposite ends thereof so that the ribs 262, 264, 66 may be moved closer and farther away from each other to facilitate opening and closing of the sun shield 210.

The sun shield has right and left hinges 263, 265 attached respectively to the right and left ends of the forward and rear ribs to maintain the shade in an open or closed condition. A sun shield cover 268 preferably made of an effective sunshine-attenuating flexible covering material to block the sun is attached to the ribs 262, 264, 266 in a manner so that when the ribs 262, 264, 266 are spread open, the sun shield cover 268 is stretched open and when the ribs 262, 264, 266 are pushed close together, the sun shield cover 268 collapses above and between them. The right and left adjusting knobs 270, 272 each have a threaded support member 286 attached to the center of the knob. Threaded onto the threaded support member 286 is a stop ring 292 with a bore therein to prevent the knob from contacting the attacher 288 which is also threaded onto the threaded support member 286. The attacher 288 has a bore therein and a hook 290 attached to the top of it to place over the edge of a beach chair or the like. The knob with the threaded support member 286 is then rotated until the end of the threaded support member 286 contacts the edge of the chair.

Although preferred embodiments are specifically illustrated and described herein, it will be appreciated that modifications and variations of the present invention are covered by the above teachings and within the purview of the appended claims without departing from the spirit and intended scope of the invention.

What is claimed as new and desired to be protected by Letters Patent of the United States is:

1. A head rest comprising:

a plurality of ribs, each said rib having two ends and each being pivotable at its respective said ends;

a shield cover stretched across said ribs;

wherein when said ribs are pivoted away from each other, said material cover is stretched open, and when said ribs are pivoted towards each other, said cover collapses over and between said ribs;

attaching means at said ends of the ribs;

a frame having two ends of said frame, and including at least one upright side frame member at each of said ends and at least two base frame members extending between said side frame members; and a closable bag fitting over and supported by said frame to provide a head rest thereon and carry items therein, said attaching means attaches said ends of said ribs through said bag to said upright side frame members.

2. The sun shield of claim 1 further comprising:

an interior bag sized to fit in said closable bag and removable therefrom to carry items therein.

3. The sun shield of claim 1 further comprising:

a headrest pillow removably attached to a top of said closable bag.

4. The sun shield of claim 1 further comprising:

handle means positioned at the top of said sun shield adapted to be grasped and to hold together said ribs of said sun shield.

5. A combined head rest and bag comprising:

a frame having two ends and including right and left side frame members at each of said ends, and front and rear base frame members extending between said side frame members;

a closable bag to carry items fitting over and supported by said frame;

left and right knobs;

a sun shield including three ribs that each have two ends and that attach to said knobs and covering material stretched across said ribs;

attaching means to attach said left and right knobs through said bag to said left and right side frame members respectively at opposite ends thereof;

a removable padded headrest pillow removably attached to a top of said closable bag;

handle means positioned at the top of said collapsible sun shield adapted to be grasped and to hold together the ribs of said collapsible sun shield;

an exterior bag attached to said closable bag to carry items therein; and fixing means to fix an alarm to said exterior bag.

6. The sun shield of claim 5 further comprising:

at least one hinge attached to at least two of said ribs to maintain said sun shield in an open or closed position.

* * * * *